US006302363B1

(12) United States Patent
Olson et al.

(10) Patent No.: US 6,302,363 B1
(45) Date of Patent: Oct. 16, 2001

(54) REFRIGERATOR MAGNET

(76) Inventors: Lois J. Olson; David V. Olson, both of 689 Sunset Ct., Shoreview, MN (US) 55126

( * ) Notice: Subject to any disclaimer, the term of this patent is extended or adjusted under 35 U.S.C. 154(b) by 0 days.

(21) Appl. No.: 09/404,644

(22) Filed: Sep. 24, 1999

Related U.S. Application Data

(60) Provisional application No. 60/122,515, filed on Mar. 3, 1999.

(51) Int. Cl.[7] ..... A47G 1/17

(52) U.S. Cl. ..... 248/206.5; 248/309.4; 24/303

(58) Field of Search ..... 248/206.5, 309.4, 248/683, 205.1; 24/303; 40/661.01, 600, 621, 711

(56) References Cited

U.S. PATENT DOCUMENTS 2,693,370 * 11/1954 Wheatley ..... 24/67 R
4,830,321 * 5/1989 Irie ..... 248/206.5
4,971,278 * 11/1990 Woods ..... 248/206.5
5,702,778 * 12/1997 Andonian ..... 428/5
5,782,445 * 7/1998 Cleck ..... 248/206.5
5,996,821 * 12/1999 Farber et al. ..... 211/89.01
6,106,937 * 8/2000 Hamerski ..... 428/343
6,153,279 * 11/2000 Charley ..... 428/40.1

* cited by examiner

*Primary Examiner*—Anita King
*Assistant Examiner*—Naschica S. Morrison

(57) ABSTRACT

A refrigerator magnet for holding thin non-magnetic sheet material, such as paper, against a flat, smooth, magnetically attractive metallic surface, such as a refrigerator door. It comprises a one-piece rigid unitary body having a first bottom planar magnetic surface and at least one other adjoining bottom planar magnetic surface. The magnetic surfaces are joined along a common bend line at an obtuse angle. In use one of the magnetic surfaces is in contact with the metallic surface, leaving one or more paper-receiving gaps between the other magnetic surfaces(s) and the metallic surface. The bend line functions as a fulcrum whereby the body may be flipped by application of finger pressure to lift the first magnetic surface from the metallic surface and cause one of the other magnetic surfaces to clamp the paper and hold it magnetically against the metallic surface. The magnetic attraction between the body along the bend line and the magnetic surface holds the body in place while being flipped from one position to another.

9 Claims, 3 Drawing Sheets

REFRIGERATOR MAGNET

This application claims benefit of provisional No. 60/122,515 filed Mar. 3, 1999.

FIELD OF THE INVENTION

1. Background of the Invention

This invention is directed to a magnetic device, commonly referred to as a refrigerator magnet, which is used to hold paper memos, notices, notes, photos, and similar thin sheet materials against flat, smooth, usually vertically oriented, metallic surfaces such as refrigerators, stoves, file cabinets and other storage cabinets, automotive bodies and the like. The refrigerator magnet body of the present invention is characterized by its extreme simplicity, its one-piece unitary construction and its user friendliness due to its easy loading and easy release features.

When compared to the typical flat refrigerator magnet the magnet of this invention is more user friendly as it 1) overcomes the difficulty associated with the user's need to get underneath the magnet with one's fingernails or fingertips in order to insert or remove a piece of paper from underneath it and 2) avoids the situation where the user has to hold the magnet in place while trying to insert or remove the paper from underneath it. Previous attempts to create a better refrigerator magnet have been, at best, relatively complicated and cumbersome.

2. Description of the Prior Art

Irie U.S. Pat. No. 4,830,321 is directed to a multi-part magnetic holder having a fixed magnet which is attachable on one side to a surface either magnetically or adhesively. A movable body made of a magnetically attractive material is loosely attached by a pin to the opposite side of the magnet. The movable body is divided into two or more segments separated by bend lines and defining separate planes such that only one segment is attracted to the magnet at any one time. The bends function as fulcrums to shift the magnetic attraction from one segment of the movable body to another. A non-magnetic covering body is attached over the movable body and has clipping parts which extend over the edges of the movable body to engage sheet material to be held by the holder when the movable body segment adjacent to the clipping part is in engagement with the fixed magnet.

Wheatley U.S. Pat. No. 2,693,370 is directed to a multi-part paper holder in the nature of a clipboard having a base of magnetic material. A non-magnetic paper holder body partially encloses one or more magnets each having a clamp face and a rest face joined along a common edge forming a fulcrum or pivot permitting the holder body to be rocked to either of two positions. When the rest faces of the magnets engage the magnetic base the paper holder is held in a paper-receiving rest position. When the holder is rocked on the fulcrum the clamp faces of the magnet may hold paper or similar sheet material against the base.

Woods U.S. Pat. No. 4,971,278 is directed to a refrigerator magnet in the form of a small horseshoe or ponyshoe. A pair of aligned magnets are disposed midway between the ends of the shoe arms to hold the shoe body spaced from a magnetizable surface, such as a refrigerator door, and to serve as a fulcrum or pivot to permit the shoe to be tilted relative to the surface. A frictional holding element such as another magnet is disposed at the toe of the shoe. When manual force is applied to the face end of one of the shoe arms the frictional holding element is lifted from the magnetizable surface to permit a sheet of paper or the like to be slipped under it. Upon release of the manual force the paper is held clamped in place.

SUMMARY OF THE INVENTION

Broadly stated the invention is directed to a magnetic device for holding thin non-magnetic sheet material against a flat, smooth, magnetically attractive metallic surface. It comprises a one-piece rigid unitary body having a first bottom planar magnetic surface and at least one other adjoining bottom planar magnetic surface. The magnetic surfaces are joined along a common bend line at an obtuse angle. The bend line functions as a fulcrum whereby manual force applied to the top surface of the unitary body causes the bottom magnetic surfaces to be alternately engageable with a magnetically attractive surface, such as a refrigerator door, in direct contact with the door and through non-magnetic sheet material to be attached to the door.

BRIEF DESCRIPTION OF THE DRAWINGS

The invention is illustrated in the accompanying drawings in which corresponding parts are identified by the same numerals and in which.

DETAILED DESCRIPTION OF THE PREFERRED EMBODIMENT

Figure 1:
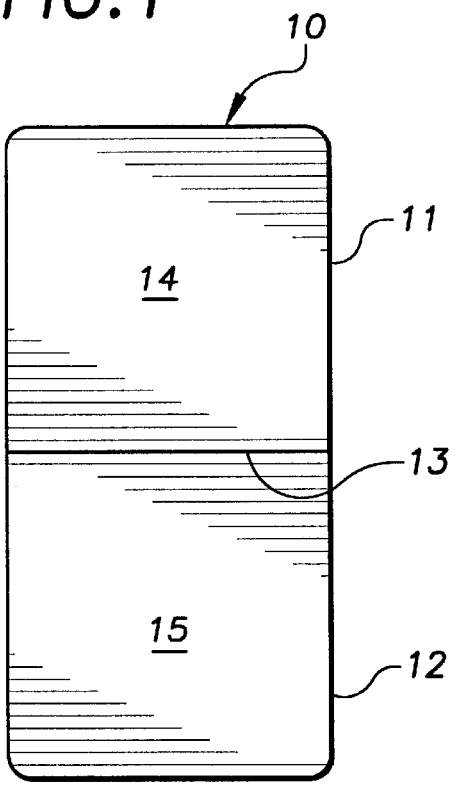
FIG. 1 is a bottom plan view of a refrigerator magnet according the the present invention.
Figure 2:
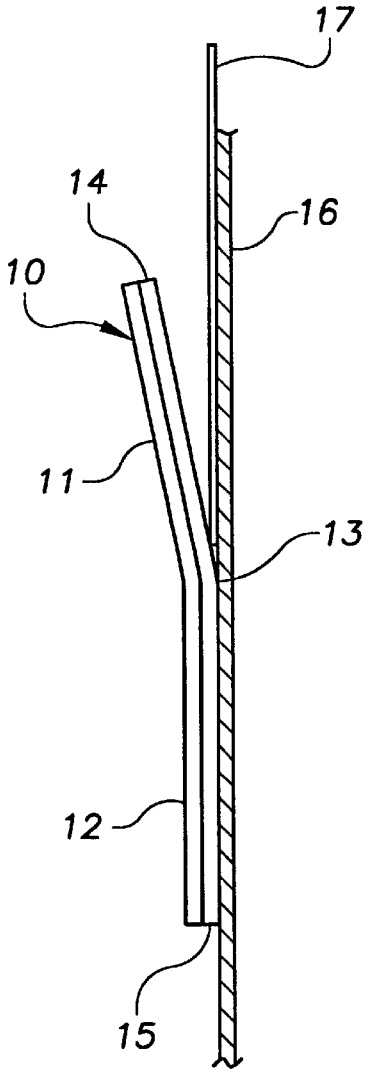
FIG. 2 is a side elevation thereof showing a magnet receiving a piece of sheet material to be attached to a metal surface.
Figure 3:
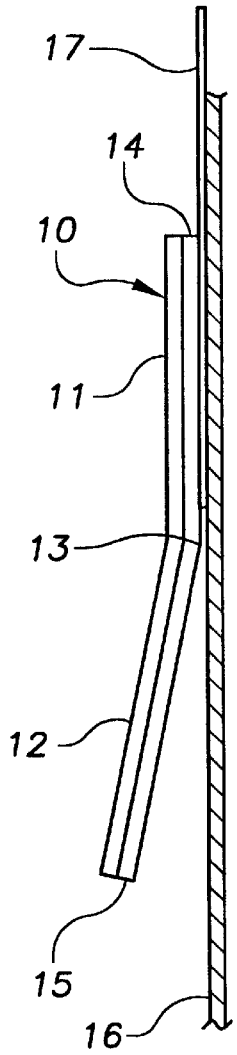
FIG. 3 is a similar side elevation showing the sheet material held against the metal surface.

Referring now to the drawings, and particularly to FIGS. 1 through 3, there is shown a refrigerator magnet having a unitary one-piece rigid body indicated generally at 10 and composed of two body segments 11 and 12. Body segments 11 and 12 are joined together along a common bend line 13 at an obtuse angle. Body segment 11 has a bottom planar magnetic surface 14 and body segment 12 has a bottom planar magnetic surface 15. The bends may be sharply angular or rounded or curved.

Body 10 may be composed wholly of a flat relatively thin (about 1/16 to 1/4 inch) magnetized iron or steel sheet material or of a rigid non-magnetic synthetic resinous plastic such as polystyrene, polypropylene, acrylic, or the like, having finely divided magnetic particles distributed throughout the body. Alternatively, the magnetic surfaces may be formed by a magnetic coating applied to a similar rigid non-magnetic body. Preferably, as shown in FIGS. 2 and 3, the magnetic surfaces are formed from magnetic sheet material permanently bonded, as by adhesive, to become part of the one-piece unitary body.

As shown in FIGS. 1 to 3, magnetic sheet material having planar magnetic surfaces 14 and 15 is co-extensive in size with the non-magnetic body segments 11 and 12.

The magnetic surfaces are joined at an obtuse angle of about 185 to 200 degrees and preferably about 185 to 190 degrees. Thus, when the refrigerator magnet is applied to a magnetically attractive flat surface one of the magnetic surfaces of the body is in intimate face-to-face contact and the other is spaced from the magnetically attractive surface by an included angle of about 5 to 20 degrees, preferably about 5 to 10 degrees. Although the body 10 is shown as rectangular, composed of abutting squares, it may take a variety of forms. The segments may be the same or different and may be polygonal in configuration, truncated circles or the like, with smooth or irregular edges.

The manner in which the refrigerator magnet is used is shown in FIGS. 2 and 3. The body is placed with one of the magnetic surfaces 15 in contact with a flat magnetically attractive iron or steel wall surface 16, as shown in FIG. 2. Thus, because of the angular relationship of the planar magnetic surfaces, magnetic surface 14 is angularly spaced from the wall 16. A piece of paper, a photo, or other thin non-magnetic sheet material 17 is readily inserted in the gap between magnetic surface 14 and wall 16. Bend line 13 functions as a pivot or fulcrum to permit the magnetic surfaces to be tilted so that alternately one or the other is in magnetic contact with the wall, either directly or through the sheet material 17.

Application of manual force, as by a finger, on the top surface of body segment 11 causes body segment 12 and magnetic surface 15 to be lifted from the surface of wall 16 in a lever action and causes body segment 11 and magnetic surface 14 to be flipped into contact with wall 16, the magnetic attraction penetrating through the sheet material 17, as shown in FIG. 3. During the brief instant in which both magnetic planar surfaces are out of contact with wall 16, bend line 13 remains in magnetic contact with the wall so that the body remains in place. The fulcrum at bend line 13 may be lifted from the wall surface by the thickness of the sheet material 17 but remains in magnetic contact with the wall to permit the body to be flipped in the opposite direction and the sheet material to be removed by application of force to body segment 12. Although the magnet is shown disposed vertically to permit insertion of sheet material from above, obviously it may be disposed in any directional orientation.

Figure 4:
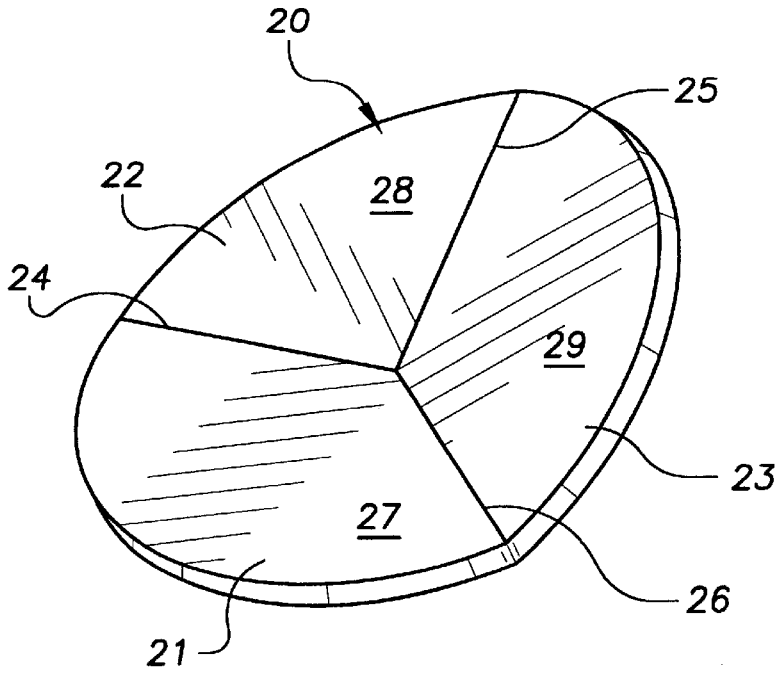
FIG. 4 is a bottom plan view of an alternative form of refrigerator magnet according to the present invention.

Referring to FIG. 4 there is shown an alternative form of refrigerator magnet according to the present invention having a one-piece unitary rigid body indicated generally at 20 and composed of three body segments 21, 22 and 23. Body segments 21 and 22 are joined together along a common bend line 24 at an obtuse angle; body segments 22 and 23 are joined together along a common bend line 25 at an obtuse angle; and body segments 23 and 21 are joined together along a common bend line 26. Body segment 21 has a bottom planar magnetic surface 27; body segment 22 has a bottom planar magnetic surface 28; and body segment 23 has a bottom planar magnetic surface 29.

The composition and construction of this alternative form of magnet are similar to those of the magnet of FIG. 1. The bend lines 26–28 function as fulcrums as heretofore described. In this instance, with one magnetic surface in contact with a metal surface there is a choice of two angular gaps or spaces in which to insert the sheet material to be held. Finger pressure on the top side of the body segment selected will cause the body to flip to hold the sheet material. For example, if magnetic surface 27 is in contact with a metal wall and a paper is inserted behind body segment 23 in the space between magnetic surface 29 and the wall, force applied to the top surface of body segment 23 will cause the body to pivot on bend line 26 to flip magnetic surface 29 into magnetic contact with the wall through the paper to be held. Although body 20 is shown as having a circular configuration it may be triangular, or hexagonal, or any of a myriad of other configurations.

Figure 5:
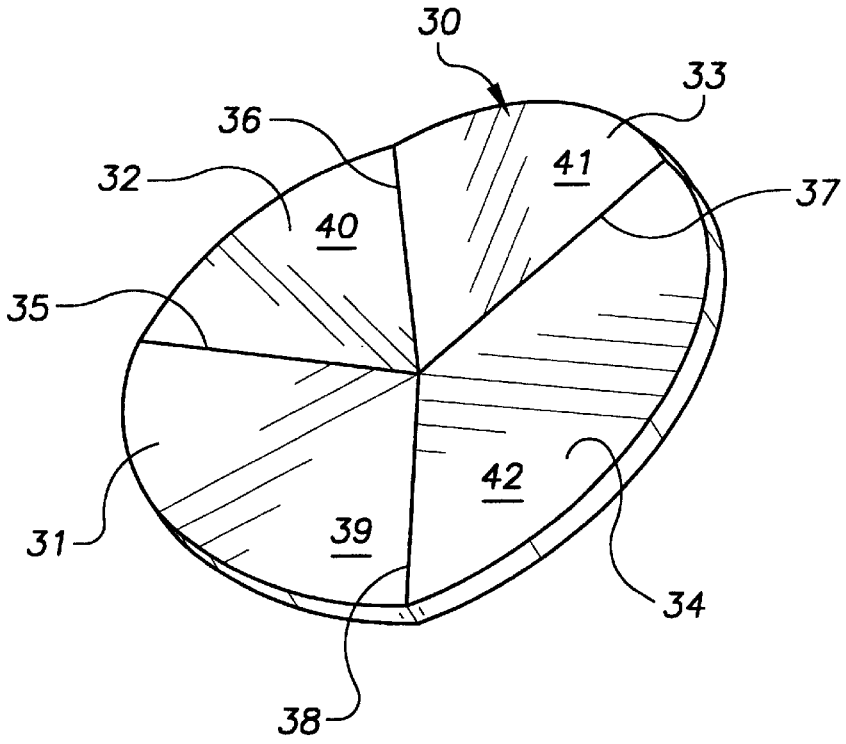
FIG. 5 is a bottom plan view of a further alternative form of magnet.

FIG. 5 shows a further alternative form of refrigerator magnet having a one-piece unitary rigid body indicated generally at 30 and composed of four body segments 31, 32, 33 and 34. Body segments 31 and 32 are joined together along a common bend line 35 at an obtuse angle. Similarly segments 32 and 33 are joined along bend line 36, segments 33 and 34 are joined along bend line 37 and segments 34 and 31 are joined along bend line 38. Body segments 31–34 have bottom planar magnetic surfaces 39–42, respectively.

The composition, construction and mode of operation of this form of magnet are generally similar to those previously described. The bend lines function as fulcrums to permit flipping of the body to alternate the magnetic surfaces in contact with a metal surface. The body may be composed of five or more segments. The overall configuration of the body is subject to wide variation.

Figure 6:
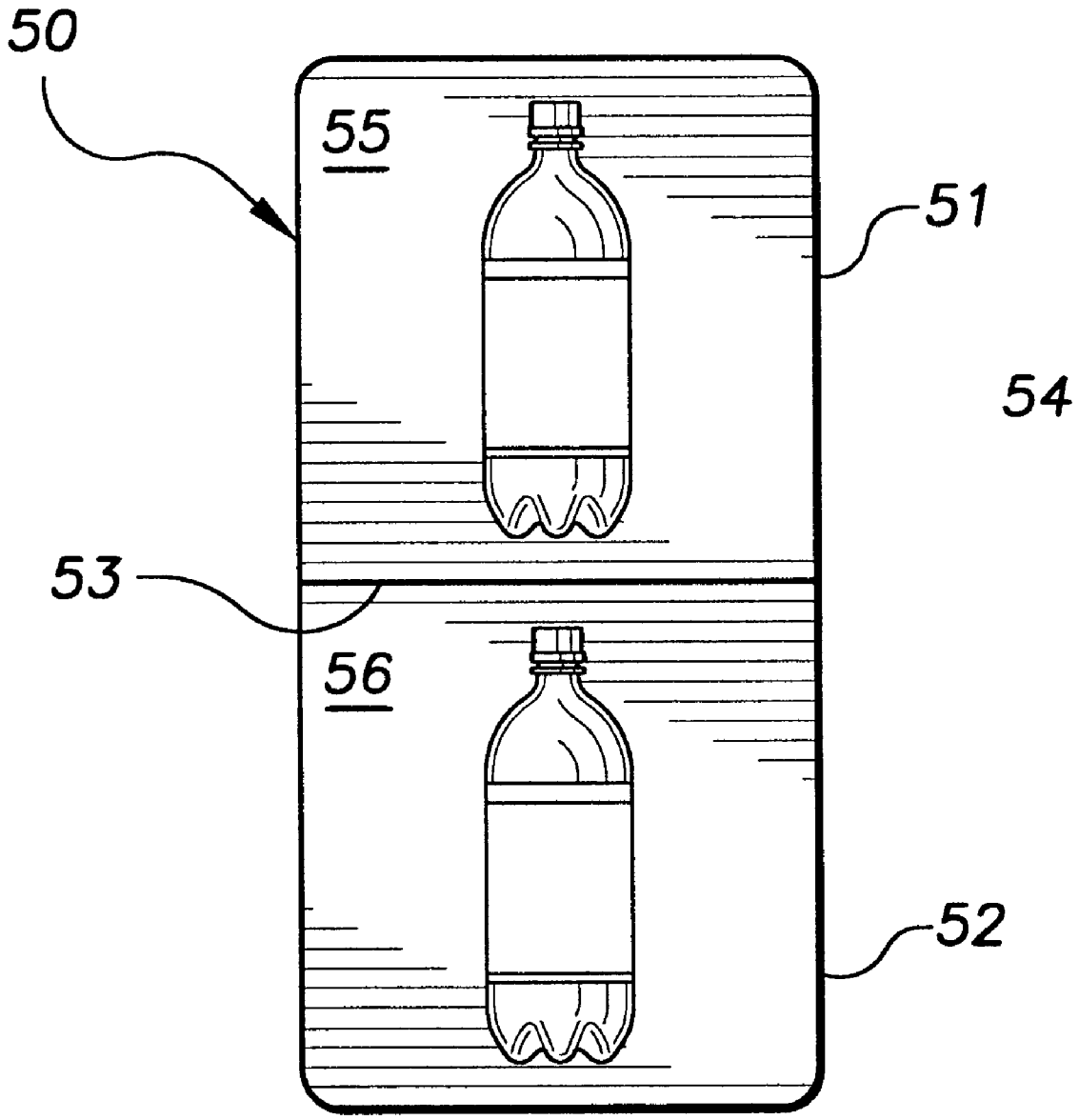
FIG. 6 is a top plan view of a variation of the magnet of FIG. 1.

The refrigerator magnet of this invention readily is adapted to a variety of promotional and advertising uses. When the top surfaces of the body segments are flat and smooth as shown in FIGS. 2 and 3 they may be imprinted with advertising messages, logos or other designs, or other indicia as desired. FIG. 6 shows in top plan view a modified form of magnet similar to that of FIG. 1 having a unitary one-piece rigid body indicated generally at 50 and composed of two body segments 51 and 52 joined together along a common bend line 53. A three dimensional representation 54 of an advertised product, or other object may be molded in the top surfaces 55 and 56, respectively, of body segments 51 and 52. Alternatively a three-dimensional representation may be adhesively bonded to the top surfaces.

It is apparent that many modifications and variations of this invention as hereinbefore set forth may be made without departing from the spirit and scope thereof. The specific embodiments described are given by way of example only and the invention is limited only by the terms of the appended claims.

We claim as our invention:

1. A magnet for holding thin non-magnetic sheet material against a flat smooth magnetically attractive surface, said magnet comprising a one-piece sheet-like relatively thin rigid unitary body having first and second non-magnetic body segments joined together along a common bend line at an obtuse angle, said first and second body segments having bottom surfaces, said bottom surfaces having substantially the same surface areas, magnetic sheet material having planar magnetic surfaces substantially co-extensive in size with the body segments secured to the bottom surfaces of the body segments, said magnetic sheet material having a bend line generally parallel to the bend line of the body segments, said bend line of the magnetic sheet material functioning as a fulcrum whereby all of said bottom magnetic surfaces are alternately engageable with a magnetically attractive surface in direct contact therewith and through said thin non-magnetic sheet material to be held against the magnetically attractive surface.

2. A magnet according to claim 1 wherein said obtuse angle is between about 185 and 200 degrees.

3. A magnet according to claim 1 wherein the top surface of the unitary body opposite from said bottom magnet surfaces is relatively flat and smooth, whereby the top surface may be imprinted with advertising or other indicia.

4. A magnet according to claim 1 wherein said unitary body is generally rectangular in configuration.

5. A magnet for holding thin non-magnetic sheet material against a flat smooth magnetically attractive surface, said magnet comprising a one-piece relatively thin rigid unitary body, said unitary body includes at least three bottom flat planar magnetic surfaces alternately engageable with said magnetically attractive surface, adjacent magnetic surfaces being joined along a common bend line at an obtuse angle, said bend line functioning as a fulcrum whereby all of said bottom magnetic surfaces are alternately engageable with a magnetically attractive surface in direct contact therewith and through said thin non-magnetic sheet material to be held against the magnetically attractive surface.

6. A magnet according to claim 5 wherein said obtuse angle is at least 185 degrees.

7. A magnet according to claim 6 wherein said obtuse angle is between about 185 and 200 degrees.

8. A magnet for holding thin non-magnetic sheet material against a flat smooth magnetically attractive surface, said magnet comprising a one-piece relatively thin rigid unitary body having first and second non-magnetic body segments joined thereto along a common bend line at an obtuse angle of about 185 to 200 degrees, magnetic sheet material secured to the body segments having planar bottom magnetic surfaces substantially co-extensive in size with the body segments, said magnetic sheet material having a bend line generally parallel to the bend line of the body segments, said bend line of the magnetic sheet material functioning as a fulcrum whereby all of said bottom magnetic surfaces are alternately engageable with a magnetically attractive surface in direct contact therewith and through said thin non-magnetic sheet material to be held against the magnetically attractive surface, and the top of said unitary body opposite from said bottom magnetic surfaces is relatively flat and smooth, whereby the top of said unitary body may be imprinted with advertising or other indicia.

9. A magnet according to claim 8 wherein said unitary body is generally rectangular in configuration.

* * * * *